US010006168B2

(12) United States Patent
Pouyet et al.

(10) Patent No.: US 10,006,168 B2
(45) Date of Patent: Jun. 26, 2018

(54) METHOD FOR TREATING CHEMICAL PULPS BY TREATMENT WITH OZONE IN THE PRESENCE OF MAGNESIUM IONS

(71) Applicants: L'Air Liquide Societe Anonyme Pour L'Etude et L'Exploitation Des Procedes Georges Claude, Paris (FR); Association de Gestion De L'Ecole Francaise de Papeterie et des Industries Graphiques (AGEFPI), Saint Martin d'Heres (FR); Degremont France, Rueil Malmaison (FR); Xylem Water Solutions Herford GmbH, Herford (DE); Arkema France, Colombes (FR)

(72) Inventors: Frederic Pouyet, Grenoble (FR); Dominique Lachenal, Echirolles (FR); Christine Chirat, Grenoble (FR)

(73) Assignees: L'Air Liquide Societe Anonyme Pour L'Etude et L'Exploitation Des Procedes Georges Claude, Paris (FR); Association de Gestion De L'Ecole Francaise de Papeterie et des Industries Graphiques (AGEFPI), Saint Martin d'Heres (FR); Degremont France, Rueil Malmaison (FR); Xylem Water Solutions Herford GmbH, Herford (DE); Arkema France, Colombes (FR)

( * ) Notice: Subject to any disclaimer, the term of this patent is extended or adjusted under 35 U.S.C. 154(b) by 0 days. days.

(21) Appl. No.: 14/896,031

(22) PCT Filed: Jun. 13, 2014

(86) PCT No.: PCT/FR2014/051460

§ 371 (c)(1),
(2) Date: Dec. 4, 2015

(87) PCT Pub. No.: WO2014/199101

PCT Pub. Date: Dec. 18, 2014

(65) Prior Publication Data

US 2016/0130751 A1 May 12, 2016

(30) Foreign Application Priority Data

Jun. 13, 2013 (FR) ..... 13 55496

(51) Int. Cl.

| | |
|---|---|
| ***D21C 9/153*** | (2006.01) |
| ***D21C 9/02*** | (2006.01) |
| ***D21C 9/08*** | (2006.01) |
| ***D21C 9/10*** | (2006.01) |
| ***D21C 9/00*** | (2006.01) |

(52) U.S. Cl.
CPC ..... *D21C 9/1073* (2013.01); *D21C 9/002* (2013.01); *D21C 9/004* (2013.01); *D21C 9/005* (2013.01); *D21C 9/08* (2013.01); *D21C 9/083* (2013.01); *D21C 9/086* (2013.01); *D21C 9/153* (2013.01)

(58) Field of Classification Search
CPC .... D21C 9/153; D21C 9/1026; D21C 9/1057; D21C 9/1073; D21C 9/163; D21C 9/002; D21C 9/004; D21C 9/005; D21C 9/083; D21C 9/086; D21C 9/10; D21C 9/16
See application file for complete search history.

(56) References Cited

U.S. PATENT DOCUMENTS

| | | | | | |
|---|---|---|---|---|---|
| 3,384,533 | A | | 5/1968 | Robert et al. | |
| 4,283,251 | A | * | 8/1981 | Singh | D21C 9/1073 162/17 |
| 4,372,812 | A | * | 2/1983 | Phillips | D21C 9/1057 162/40 |
| 4,734,161 | A | | 3/1988 | Dubreux | |
| 4,959,124 | A | * | 9/1990 | Tsai | D21C 9/1057 162/65 |
| 5,169,495 | A | * | 12/1992 | Lachenal | D21C 9/163 162/78 |
| 5,346,588 | A | * | 9/1994 | Sixta | D21H 17/00 162/65 |
| 5,387,317 | A | * | 2/1995 | Parthasarathy | D21C 9/147 162/65 |
| 5,656,130 | A | * | 8/1997 | Ali | D21C 9/166 162/65 |
| 5,853,535 | A | * | 12/1998 | Maples | D21C 9/1026 162/30.1 |

(Continued)

FOREIGN PATENT DOCUMENTS

| | | | | |
|---|---|---|---|---|
| FR | 1387853 A | | 2/1965 | |
| FR | 2692917 A1 | * | 12/1993 | D21C 9/1084 |

(Continued)

OTHER PUBLICATIONS

Chirat et al., "Use of a Reducing Stage to Avoid Degradation of Softwood Kraft Pulp After Ozone Bleaching", Paperi Ja Puu, vol. 76, No. 6-7, 1994, pp. 417-422.
Robert W. Allison, "Efficient Ozone and Peroxide Bleaching of Alkaline Pulps From *Pinus radiata*", APPITA Journal, vol. 36, No. 1, 1982, pp. 42-46.
The Ljungberg Textbook, Pulp Technology, KTH Stockholm Editor, Chapter 27, p. 11 and p. 25, 2004.
Suess et al., "ECF Bleaching of Softwood Kraft Pulp: Understanding the Potential of Extraction", Pulp & Paper Canada, 108 7/8, 2007, 4 pages.
Search Report and Written Opinion in International Application No. PCT/FR2014/051460 dated Sep. 1, 2014.

*Primary Examiner* — Jose A Fortuna
(74) *Attorney, Agent, or Firm* — Marshall, Gerstein & Borun LLP

(57) ABSTRACT

This invention relates to a method for treating chemical paper pulp comprising a step of treating the pulp with ozone followed by a step of alkaline extraction, in which alkaline extraction takes place in the presence of magnesium ions ($Mg^{2+}$).

13 Claims, No Drawings

(56) References Cited

U.S. PATENT DOCUMENTS 6,398,908 B1 * 6/2002 Hermansson ..... D21C 9/1005 162/65
6,458,242 B1 * 10/2002 Bokstrom ..... D21C 9/1036 162/40
6,793,771 B2 * 9/2004 Sundaram ..... D21C 9/153 162/57
7,368,036 B2 * 5/2008 Tolan ..... D21C 5/005 162/65
8,268,120 B2 * 9/2012 Pipon ..... D21C 9/153 162/65
8,568,558 B2 * 10/2013 Dietz ..... D21C 9/1036 162/78
2004/0163779 A1 * 8/2004 Pan ..... D21B 1/16 162/5
2010/0065233 A1 * 3/2010 Pipon ..... D21C 9/153 162/65
2012/0031575 A1 * 2/2012 Khandelwal ..... D21C 9/10 162/78
2012/0118518 A1 * 5/2012 Calais ..... D21B 1/16 162/65
2015/0352540 A1 * 12/2015 Hodge ..... B01J 31/182 435/99
2016/0130751 A1 * 5/2016 Pouyet ..... D21C 9/002 162/65
2016/0177503 A1 * 6/2016 Lund ..... D21C 5/005 435/192
2016/0298294 A1 * 10/2016 Dietz ..... D21C 3/00

FOREIGN PATENT DOCUMENTS

WO WO-95/06773 A1 3/1995
WO WO 9506773 A1 * 3/1995 ..... D21C 9/1057
WO WO 2008071718 A1 * 6/2008 ..... D21C 9/153
WO WO-2010/046768 A1 4/2010

* cited by examiner

METHOD FOR TREATING CHEMICAL PULPS BY TREATMENT WITH OZONE IN THE PRESENCE OF MAGNESIUM IONS

TECHNICAL FIELD

The invention relates to the treatment of chemical paper pulps, in particular to the bleaching of chemical paper pulps, especially kraft, soda or sulfite pulps.

In the frame of the present invention, it has been shown that during a chemical paper pulp process including ozone processing followed by alkaline extraction, it was possible to reduce the depolymerization of the cellulose substantially if the alkaline extraction takes place in the presence of magnesium ($Mg^{2+}$) cations.

PRIOR ART

Paper pulps, known as chemical paper pulps or chemical papermaking pulps are obtained, after cooking the wood using reagents that remove the greater share of lignin, such as soda possibly catalyzed by quinones (soda process used for obtaining soda pulps), soda combined with sodium sulfide (kraft process used in the production of kraft paper) or bisulfites (sulfite process used for obtaining sulfite pulps).

In the conventional process to produce bleached chemical paper pulps, a first phase known as delignification or pre-bleaching involves the removal of approximately half the lignin contained by the pulp. This operation, conventionally carried out by a chemical treatment with oxygen (O), is inherently accompanied by the bleaching of the pulp, because of the depletion of brown colored lignin.

The following phase, known as bleaching, consists in removing all the residual lignin, keeping only the "carbon hydrates" (cellulose and hemicellulose) fraction, which is totally white. This treatment is based on the oxidization of the phenolic cycles in the lignin which, after being converted into —COOH hydrophilic groups, can be eliminated by washing in a solution, advantageously in an alkaline medium, to enhance their solubilization.

In general, chemical paper pulp bleaching is carried out by a succession of processes, referred to as the bleaching sequence, implementing one or several oxidants, the most generalized of which are chlorine dioxide or $ClO_2$ (processing referred to as D), oxygen or $O_2$ (processing referred to as O), and bleach or hydrogen peroxide or $H_2O_2$ (processing referred to as P).

These oxidant treatments degrade the residual lignin, essentially responsible for the color of paper pulp after cooking, and several other chromophores to be found in the pulp. These reagents form carboxyl groups on the lignin and the other chromophores, making them hydrophile and causing their solubilization in the water of the reaction medium. However, solubilization is only effective when the medium is alkaline, as in the case of O and P treatments. However, when the oxidant is only active in an acidic medium, as in the case of chlorine dioxide (D), it becomes necessary to have the oxidant processing followed by alkaline processing using soda (E), possibly reinforced by an oxidant which is active in alkaline medium (oxygen and/or bleach), added in small quantities, according to the processing Eo or Ep, or even Eop (the lower-case letters indicate the use of small amounts of oxidant in the E processing).

Accordingly, a complete conventional bleaching process can comprise, for instance, the OODE(or Eo or Ep or Eop)DP sequence, in which:

OO represents two successive oxidizations by oxygen in an alkaline medium;

D is an oxidization stage using chlorine dioxide in an acidic medium;

E is a process to extract oxidized products in the presence of soda, whose variants can consist in adding oxygen (Eo) and/or hydrogen peroxide (Ep) in small quantities; and P is processing by bleach in an alkaline medium.

Today, more than 95% of chemical pulps are bleached by a sequence containing a chlorinated oxidant such as chlorine dioxide ($ClO_2$), dichlorine ($Cl_2$), sodium hypochlorite (NaClO) or calcium hypochlorite ($Ca(ClO)_2$). These lead to the forming of organochlorine compounds found essentially in bleaching effluents but which can also contaminate the bleached pulp. The real impact of these compounds on the plant environment and the quality of the papers has been open to discussion for several decades. Nevertheless, the papermaking industries are seeking to reduce the forming of these organochlorine compounds by different means. One of the most widespread solutions consists in privileging, among the chlorine-containing agents, the use of chlorine dioxide ($ClO_2$), which produces far less organochlorine compounds than dichlorine or hypochlorites. Furthermore, it has no detrimental effect on cellulose, unlike the other chlorinated oxidants. The bleached pulps produced are of the highest quality. However, organochlorine compounds are nevertheless still formed. One more comprehensive means would involve replacing all the chlorinated reagents by other non-chlorinated oxidants. Oxygen (O) and bleach (P) are already extensively used. However, they do not have the capability of fully bleaching kraft pulps.

Beginning in 1992, ozone (processing referred to as Z) has been added to the list of reagents used in the bleaching process. Ozone is a highly promising oxidizing agent in this context since its delignification efficiency exceeds that of chlorine dioxide for the same applied reagent quantity.

Like chlorine dioxide (D), ozone works in acidic medium. Accordingly, in the same way as for delignification by chlorine dioxide, delignification by ozone must be combined with alkaline extraction (E) to be more complete. Therefore, the delignification process using ozone is generally referred to as ZE, indicating that oxidization by ozone in an acidic medium is followed by alkaline extraction, advantageously in the presence of soda. Note that these two steps may be separated by washing, generally with water, which helps increase the reaction pH. If washing is not used, the processing is then referred to as [ZE].

In practice and until now, several plants across the world use ozone in bleaching sequences of the OOZEP type, for instance, for the complete replacement of chlorinated reagents, or OOZDEP, for instance, for the possible replacement of chlorine dioxide.

The primary drawback that is now impeding the development of this type of bleaching sequence is the oxidization and depolymerization of cellulose occurring during the ozone stage and in the following alkaline processing. The process of delignification by ozone ZE depolymerizes the cellulose significantly.

Research has been conducted into solutions of this technical problem familiar to the person skilled in the art.

Accordingly, Chirat et al. (Paperi Ja Puu, vol 76, No. 6-7 pages 417-422 (1994)) proposed to interpose a reducing stage between Z and E, preferably using sodium borohydride. The improvement is evident under these conditions. However, sodium borohydride is a very costly reagent, ruling out its industrial application, and no alternate reagent has been proposed for the time being.

Another solution consists in carrying out the ZE treatment in two steps according to the ZEZE sequence, sharing out the ozone load between the two Z processing stages (R. W. Allison, APPITA Journal, vol 36 No. 1 pages 42-46 (1982)). Despite some improvement, the depolymerization of the cellulose is still considerable in the absence of any chemical action to eradicate the depolymerization caused by ozonation followed by alkaline extraction.

This invention is, therefore, part of the research for technical solutions to prevent or decrease the depolymerizing of cellulose from chemical paper pulp, as observed during the processing by the ZE sequence.

DESCRIPTION OF THE INVENTION

This invention is based on the observation, by the inventors, of the fact that the degradation of cellulose in this context is very probably initiated during ozone processing but worsens in alkaline medium.

Accordingly, while in the prior art, attention was focused entirely on the ozone processing phase itself, in particular by attempting to protect the pulp from free radicals, what is more without any real success, it has been demonstrated as part of this invention that action on alkaline extraction (and therefore possibly after the ozone processing) produces satisfactory results.

In addition, this invention offers a definite technical solution, that is, the completion of alkaline extraction in the presence of specific ions, in this case magnesium cations ($Mg^{2+}$), advantageously at a suitable concentration.

Accordingly, and in practice, the addition of magnesium ions is proposed:

during the ozone processing phase (Z), advantageously after the addition of ozone; or after ozone processing (Z) and before the addition of an alkaline solution, for instance soda for the alkaline extraction (E); or in the washing solution when the pulp is washed between ozone processing and alkaline extraction or after this washing; or possibly during the chlorine dioxide (D) processing stage, advantageously after the addition of chlorine dioxide, when it takes place between ozone processing and alkaline extraction.

Evidently, the essential condition is that the alkaline extraction (E) takes place in the presence of magnesium ions ($Mg^{2+}$). Because of the tendency of magnesium ions to precipitate in alkaline medium, they are advantageously added at a neutral or acidic pH, upstream of the actual alkaline extraction. Therefore, in practice, these cations are not added directly to the alkaline extraction solution, generally a soda solution, but are already to be found in the reaction medium when it is added.

In one preferred embodiment of the invention, the magnesium ions are added to the pulp before the alkaline solution is added to it, that is, when the pH of the pulp is non-alkaline or in other words, when the reaction medium has an acidic pH (pH less than 7) or a neutral pH (pH less than or equal to 7). This prevents the forming of low solubility magnesium hydroxide that could be detrimental to the thorough distribution of magnesium in the medium. Advantageously, the magnesium ions are added between the stage of treating the pulp with ozone and the step of alkaline extraction.

Accordingly, this invention concerns a method for treating chemical paper pulp comprising a step of treating the pulp with ozone followed by an alkaline extraction step, in which alkaline extraction takes place in the presence of magnesium ions ($Mg^{2+}$).

In this invention, the expression "treatment method" could also be understood to mean "bleaching method."

The process according to the invention is particularly suited to the processing of chemical paper pulps, for instance, soda pulps, kraft pulps or sulfite pulps, and advantageously kraft or sulfite pulps.

Chemical paper pulps, suitable for treatment by the method according to the invention, are hardwood and softwood pulps, and also non-wood pulps such as annual plants.

The method according to the invention is defined by at least two specific steps, that is, an ozonization phase and an alkaline extraction phase, advantageously with soda, while the alkaline extraction phase takes place after the ozonization phase.

In one specific embodiment, the ozonization phase is followed directly by the alkaline extraction phase. In this case, the process according to the invention comprises the sequence [ZE].

Alternatively, the ozonization phase and the alkaline extraction phase can be separated by washing, carried out advantageously with water, obtained for instance from washing carried out after subsequent additional bleaching stages, while backwash washing is particularly prevalent in the pulp bleaching process. In this case, the method according to the invention comprises the ZE sequence. Advantageously, the magnesium ions are added between the washing stage and the alkaline extraction stage.

In an alternative method, another processing step can be inserted between the ozonization and alkaline extraction phases, for instance, processing with chlorine dioxide (D), possibly followed by washing. The method according to the invention then comprises the sequence ZDE.

Advantageously, a heavy metal processing step, carried out at acidic pH and in the presence of complexing agents like EDTA, is not interposed between the ozonization phase and the alkaline extraction phase. In other words, advantageously, no complexing agent such as EDTA is added during ozone processing or between ozone processing and alkaline extraction.

Also, and in a preferential manner, a treatment according to the invention comprises a more complex sequence with upstream and/or downstream treatments of these at least two phases.

Accordingly, and in a conventional manner, the bleaching of chemical paper pulps begins with oxygen treatment (O), or even double oxygen treatment (OO). Advantageously, this treatment is carried out in an alkaline medium, under oxygen gas pressure, at a temperature of around 100° C. It allows the removal of approximately half the lignin from the pulp and triggers the pre-bleaching of the pulp.

In this situation, the two specific steps of the method according to the invention, in particular ozone treatment (Z), are advantageously implemented on a so-called pre-bleached pulp, processed by O or OO.

In a privileged manner, the sequence ZE according to the invention is advantageously carried out on a pulp having:

A brightness level equal to or greater than 40%, advantageously equal to or greater than 50%. The brightness level is determined according to the ISO 3688-197 standard; and/or a kappa number of less than or equal to 15, advantageously less than or equal to 10. These values must be compared with the kappa number of unbleached pulps which is generally between 20 and 30. The standard used for the kappa number is ISO 302-1981.

The bleaching process can also include, upstream or downstream of the ZE sequence referred to in the invention, one or several of the following treatments, in a suitable order, and implemented under conditions known to the skilled person:

Treatment with chlorine dioxide (D), carried out at acidic pH at a temperature that is advantageously comprised between 50 and 100° C., for a duration advantageously comprised between 30 min and 3 h, with quantities of chlorine dioxide advantageously comprised between 0.1% and 1% by weight compared to the weight of the pulp measured when dry, followed or not by alkaline extraction, for instance with soda, at a temperature that is advantageously comprised between 50° C. and 100° C.; and/or Treatment with oxygen (O), at basic pH and an oxygen pressure advantageously comprised between 2 and 10 bar, at a temperature advantageously comprised between 80 and 110° C. and for a duration advantageously comprised between 30 min and 1 h; and/or Treatment with hydrogen peroxide (P), at a basic pH, at a temperature advantageously comprised between 70° C. and 110° C., with quantities of hydrogen peroxide advantageously comprised between 0.3% and 3% by weight compared to the weight of the pulp measured when dry, for a duration, advantageously comprised between 1 h and 3 h; and/or Treatment by acidolysis (A) using a mineral acid, advantageously sulfuric acid, at a pH advantageously comprised between 3 and 4, at a temperature advantageously comprised between 80 and 100° C., for a duration advantageously comprised between 2 and 4 h, and advantageously in the presence of a metallic cation quenching agent like EDTA.

Accordingly, the ZE sequence referred to in the invention is advantageously integrated in a more complex process, for instance, OOAZEP, OOAPZE, OOAZDEP, OOZEDD . . . .

In a remarkable manner, the beneficial effect of the magnesium ions on the depolymerization of the cellulose is observed whatever the positioning of the ZE sequence and therefore whatever the initial bleaching state of the processed pulp.

As already mentioned, the purpose of this invention is to propose a chemical pulp bleaching process including an ozonization phase followed by an alkaline extraction phase, preferably with soda, ZE, which causes the least degradation to the cellulose. In an unexpected manner, it has been demonstrated that when phase E is carried out in the presence of small quantities of magnesium cations, the ZE process produces pulps whose cellulose polymerization degree is increased substantially.

Upstream of the ZE processing according to the invention, and advantageously, the pulp can be put through hart acid treatment as described above, to eliminate at least partially the hexenuronic acids that represent an unwanted impurity in the chemical kraft pulps of deciduous woods, in that they consume bleaching reagents and are detrimental to help brightness stability. After this acid treatment, the pulp is advantageously washed to eliminate the degradation products of the hexenuronic acids. However, if the ozonization reaction takes place at a high consistency (the consistency being defined as the mass ratio between the pulp and the pulp+water mixture), changing from the consistency of the A stage, usually comprised between 5 and 10%, to the consistency of this Z stage, usually comprised between 30 and 45%, means the elimination of a large part of the water present in stage A, making the washing operation useless.

There is also the possibility of carrying out treatment with chlorine dioxyde (D) just before the ozone treatment. The pulp can be washed between the 2 steps, but this washing is not mandatory because of the compatibility of the pH of these 2 reactions.

As concerns the ozonization phase, it takes place in a conventional manner. It can be carried out advantageously under the following conditions:

At an acidic pH, advantageously comprised between 2 and 4, or possibly comprised between 2 and 10, advantageously comprised between 4 and 8 when the ozonation is carried out at the end of the bleaching sequence;

At a temperature comprised between 0 and 100° C., advantageously between 20 and 60° C., for instance, 25° C., or possibly comprised between 60° C. and 80° C., when the ozonization is carried out at the end of the bleaching sequence;

In a range of consistencies comprised between 1 and 50%, advantageously between 8 and 12% or between 30 and 45%, i.e. at medium or high consistency;

In the presence of a quantity of ozone comprised between 0.05 and 2% by weight of dry pulp, advantageously between 0.1 and 1%, for instance, 0.6%;

For the time needed for the addition and consumption of ozone, typically a few minutes, for instance from 1 min to 2 h.

Alkaline extraction, as far as it is concerned, is by definition carried out at a basic pH (greater than 7), in the presence of a base. In an advantageous manner, it is a strong base and even more advantageously soda or sodium hydroxide (NaOH). The soda can be accompanied by another base of the same strength, for instance, sodium sulfide. This latter possibility can be advantageous in a kraft plant because the cooking reagent is a mixture of soda and sodium sulfide.

The preferable conventional conditions for alkaline extraction are as follows:

A temperature comprised between 20 and 100° C., advantageously comprised between 70° C. and 100° C.;

A range of consistencies comprised between 5 and 30%, advantageously between 8 and 12%;

A base quantity, advantageously of soda, comprised between 0.1 and 5% by weight of dry pulp, preferably comprised between 0.5 and 2%. Note that the quantity of base is that required to reach an alkaline pH. Accordingly, this quantity is greater when there is no washing before the alkaline extraction. In practice, the pH must be greater than 7, advantageously greater than 10, and even more advantageously comprised between 11 and 12;

For several minutes, for instance, 5 min, to several hours, for instance, 4 h, advantageously from 30 min to 2 h, for instance, 1 h.

In a remarkable manner, ozonization and alkaline extraction take place under conventional conditions.

The magnesium ions ($Mg^{2+}$) needed to accomplish the present invention are advantageously supplied in the form of magnesium salts. "Magnesium salt" refers to any compound capable of releasing the $Mg^{++}$ cations, for instance, magnesium sulphate ($MgSO_4$), magnesium carbonate ($MgCO_3$), magnesium hydroxide ($Mg(OH)_2$), magnesium oxide (MgO or magnesia), or magnesium gluconate ($C_{12}H_{22}MgO_{14}$). Mixtures of these salts can be used.

Preferably, the quantity of magnesium ions ($Mg^{2+}$) compared to the dry weight of the pulp is checked. Advantageously, it is:

equal to or greater than 0.01%, or even 0.02%;

less than or equal to 0.5%, or even 0.1%;

Accordingly, in this invention, "small quantities of magnesium ions" refers to a mass proportion that is advantageously comprised between 0.01 and 0.5%, and even more advantageously comprised between 0.02 and 0.1%.

In the case of the $Mg^{++}$ cations being supplied in the form of alkaline compounds (for instance MgO and $Mg(OH)_2$), the alkalinity of the E stage is advantageously linked to the presence of a strong base, advantageously NaOH, implying that the $Mg^{++}$ cations are an additive, added in small quantities.

In a preferable manner, these magnesium ions are added to the pulp as magnesium salts, advantageously by dissolution of these salts in an aqueous solution, possibly water, having an acidic or neutral pH. A solution like this can be prepared extemporaneously and added to the pulp. Alternatively, and when the pulp is already in contact with a solution, in particular, an ozone solution, a washing solution or a chloride dioxide solution, the magnesium salt can be added directly to said solution.

Note that in the papermaking field, the use of magnesium ions to protect the cellulose from depolymerization has already been recommended during an oxygen bleaching stage (O) (FR 1 387 853). At this stage, carried out in an alkaline medium in a soda solution, the cellulose is degraded because of the presence of oxygen. In fact, no depolymerization of the cellulose occurs in this alkaline medium as long as the oxygen is not present. Conversely, as soon as oxygen is added, severe depolymerization of the cellulose is observed, which is considerably attenuated when the $Mg^{2+}$ cations are added to the medium. It is accepted that peroxides, by-products of the reaction of oxygen with the pulp components, are actually responsible for the depolymerization of the cellulose (The Ljungberg Textbook, Pulp Technology, KTH Stockholm Editor, 2004, Chapter 27 page 11). The latter would decompose into highly oxidizing radical species in an alkaline medium, causing the degradation of the cellulose. This decomposition is catalyzed by the transition metal cations, inhibited by the magnesium salts.

Similarly, the addition of magnesium salts is also conventionally used in the processing of chemical paper pulp by hydrogen peroxide or bleach in an alkaline medium (The Ljungberg Textbook, Pulp Technology, KTH Stockholm Editor, 2004, Chapter 27 page 25). More generally, it is a known fact that magnesium salts are stabilizing agents in bleach.

In the method according to the invention, the situation is quite different because the magnesium salts are present in an alkaline E phase, in which neither oxygen nor bleach are added.

According to an advantageous embodiment of the treatment method according to the invention, the alkaline extraction step takes place in the presence of magnesium ions but in the absence of oxygen and/or hydrogen peroxide. In other words, in the alkaline extraction step implemented in this invention, no oxygen or bleach are added. More generally, and advantageously, alkaline extraction according to the invention is linked to the change to an alkaline pH and not to the action of an oxidizing agent, in particular, oxygen and/or hydrogen peroxide.

It is true that carrying out an alkaline extraction has already been proposed, especially in a conventional bleaching sequence based on chlorine dioxide and not based on ozone, using alkaline agents other than soda, such as magnesium (MgO) or magnesium hydroxide ($Mg(OH)_2$) (Pulp and Paper Canada, vol 108, n° 7-8 pages 41-47). However, it has been observed that replacing soda by these alkaline agents leads to lower delignification and bleaching performances. Under these conditions, the quantities of magnesium implemented are far greater than in this invention because it means replacing the soda.

Accordingly, and in a preferred embodiment, alkaline extraction takes place in the presence of magnesium ions, advantageously a magnesium salt, but also in the presence of a strong alkaline agent, advantageously soda (NaOH) or a mixture of soda and sodium sulfide. In a manner consistent with this, the magnesium ions, advantageously in the form of magnesium salts, appear in small quantities, preferably in a mass proportion equal to or greater than 0.01%, or even equal to or greater than 0.02% and less than or equal to 0.5%, or even less than or equal to 0.1%, incompatible with an alkaline agent function.

As already mentioned, following the ZE process according to the invention, the pulp can be put through other bleaching stages so that it achieves the required purity and brightness, in particular, and advantageously by the use of hydrogen peroxide.

It is also possible to repeat the specific ZE sequence of the invention in which case the process comprises, for instance, the ZEZE or [ZE][ZE] sequence. Magnesium cations are advantageously present in each of the extraction E phases of such a process. To make sure of this, it is preferable to add some each time the process according to the previously described procedure is resumed, for instance for the first E phase then for the second E phase in the case of 2 ZE steps according to the invention.

The advantage of the invention lies in the fact that the ZE process, in its various embodiments according to the invention, produces a pulp whose cellulose is less depolymerized than after an unmodified ZE process (in the absence of magnesium ions). For instance, the polymerization degree of the cellulose is measured by viscosimetry according to the ISO standard No. 5351/1-1981.

Furthermore, the purpose of a ZE process applied to a chemical pulp is to reduce its residual lignin content, responsible for its coloring, and, therefore, enhance its brightness. It is important to note that the ZE process according to the invention, for equal delignification performance and enhanced brightness, produces a pulp with a better degree of polymerization then after an unmodified ZE process.

Accordingly, and from another aspect, this invention concerns a paper pulp that is able to be obtained using a method according to the invention. In particular, this is characterized by a degree of polymerization higher than that of a pulp obtained by a procedure which is, in fact, similar but in which the alkaline extraction step (E) takes place in the absence of magnesium ions.

EXAMPLES

The invention and its resultant advantages will be understood more clearly from the following. However, these are not to be considered as limiting cases in any way.

Example 1 (According to the Prior Art)

In a known way, eucalyptus kraft pulp is processed in two successive stages using oxygen (OO) to produce a prebleached pulp, having the following properties:

Residual Lignin Factor Represented by the Kappa Number: 10;

Brightness: 51.2%;

Degree of Polymerization (DP) of the Cellulose: 1630.

Viscosimetry measures the degree of polymerization of the cellulose according to the ISO standard No. 5351/1-1981.

Following a conventional operation known as fluffing, which consists in mechanically opening the pulp structure to facilitate the reaction of the ozone with the fibres, the pulp is then processed with ozone (Z) at high consistency (40%)

at 25° C., with a quantity of ozone corresponding to 0.6% of the weight of dry pulp at a pH of 2.5 for the time needed to add the ozone (which reacts instantly), that is approximately 3 minutes. Following this treatment, the pulp is washed copiously in pure water then treated with soda (E) at a consistency of 10%, with a quantity of soda of 2% compared to the pulp, at 70° C. for 1 h. The pH of the pulp is then greater than 11.

Following this treatment, the pulp has the following characteristics:
Kappa Number: 6.1;
Brightness: 75.8%;
DP of Cellulose: 1203.

It appears that the delignification and bleaching that occur during this process are accompanied by the severe depolymerization of the cellulose.

Example 2 (According to the Invention)

The same sequence as described in example 1 is repeated but this time by adding 0.3% by weight of $MgSO_47H_2O$ (i.e. approximately 0.03% of Mg) with respect to the weight of dry pulp, after washing and before the addition of soda, that is at a moment when the pH of the pulp is not yet alkaline.

Following this treatment according to the invention, the pulp has the following characteristics:
Kappa Number: 6.0;
Brightness: 75.7%;
DP of Cellulose: 1327.

This example indicates the advantages of the invention which, while maintaining the same level of performance regarding delignification and increased brightness of the conventional ZE process, substantially reduces the depolymerization of the cellulose.

Example 3 (According to the Invention)

The same experiment as described in example 2 is reproduced except that the quantity of $MgSO_47H_2O$, in this case, is 2% (that is 0.2% of Mg) by weight compared to the weight of the dry pulp.

Following this treatment, the pulp has the following characteristics:
Kappa Number: 6;
Brightness of the Pulp: 73%;
DP of Cellulose: 1340.

In this example, it is evident that using excessive loads of MgSO4 tends to reduce the performance of the delignification and bleaching process for a very slight additional improvement of the DP of the cellulose.

Example 4

To illustrate the advantage of the ZE process according to the invention in different bleaching sequences from those demonstrated previously, the same pulp as in example 1, already put through OO treatment, is first treated by acidolysis (treatment A) at pH 3, for 3 h at 90° C., and in the presence of EDTA, a conventional sequestering agent for transition metal cations, so as to remove part of the hexenuronic acids that appear.

It is then treated by a stage using hydrogen peroxide (P) at a consistency of 10%, with 2% of hydrogen peroxide at 90° C. for 2 h.

Following this sequence, the pulp has the following characteristics:
Brightness: 68%;
DP of Cellulose: 1328.

Also, analyses reveal that it is almost free of transition metal cations, considered to be an impediment in the bleaching process.

The pulp prepared in this manner is put through ZE treatment under conventional conditions illustrated in example 1, in particular with 0.6% ozone by weight compared to the weight of the pulp measured dry.

Following this OOAPZE treatment, the pulp has the following characteristics:
Brightness: 84.8%
DP of Cellulose: 1165.

Thus, an increase of the pulp brightness is observed but with a drop in the cellulose polymerisation degree.

On the other hand, if magnesium is added under the same conditions as in example 2 (0.3% by weight of $MgSO_47H_2O$, i.e. approximately 0.03% of Mg compared to the measured dry weight of the pulp, after washing and before the addition of soda), the pulp has the following properties:
Brightness: 84.8%
DP of Cellulose: 1250.

Accordingly, for unchanged brightness there is less degradation of the cellulose. This example shows that the ZE process according to the invention maintains its full advantage when it is placed further down the bleaching sequence and on a pulp that has already been purified.

Example 5

In another embodiment of the invention, the pulp of example 1 is treated with ozone as indicated in example 1 then, without any transition, the consistency of the pulp is reduced to 10% by the soda solution and the alkaline extraction (E) continues under the conditions of example 1.

Following this [ZE] treatment, the pulp has the following characteristics:
Kappa Number: 6.4;
Brightness: 74.2%
DP of Cellulose: 1140.

This process that no longer includes the washing stage between Z and E evidently offers a lower performance than the process of example 1 (higher kappa number and lower brightness). The reduction in the polymerization degree of the cellulose remains considerable.

If the process is modified according to the invention, that is by adding the load of MgSO4 of example 2 as a solution in water (0.3% by weight of $MgSO_47H_2O$, that is, approximately 0.03% of Mg compared to the weight of dry pulp), directly after the Z phase and before the addition of the soda solution, the pulp has the following characteristics:
Kappa Number: 6.5;
Brightness: 74%;
DP of Cellulose: 1260.

The improvements to the degree of polymerization of the cellulose, due to the presence of the magnesium cations, is again high in this embodiment.

The invention claimed is:

1. Method for treating chemical paper pulp comprising:
(a) a step of treating the pulp with ozone, followed by
(b) an alkaline extraction step, comprising carrying out alkaline extraction of the treated pulp in the presence of magnesium ions (Mg2+) in an amount equal to or greater than 0.01% weight of the dry weight of the pulp, and in the absence of any of added oxygen and hydrogen peroxide.

2. Method for treating chemical paper pulp according to claim 1 wherein the magnesium ions appear in the form of at least one magnesium salt.

3. Method for treating chemical paper pulp according to claim 2, wherein the magnesium salt is selected from the group consisting of magnesium sulfate, magnesium carbonate, magnesium hydroxide, magnesium oxide, magnesium gluconate, and mixtures thereof.

4. Method for treating chemical paper pulp according to claim 1, wherein the magnesium ions represent between 0.01% and 0.5% by weight of the dry weight of the pulp.

5. Method for treating chemical paper pulp according to claim 1, comprising adding the magnesium ions at a neutral or acidic pH.

6. Method for treating chemical paper pulp according to claim 5, comprising adding the magnesium ions at a neutral or acidic pH between the step of treating the pulp with ozone and the step of alkaline extraction.

7. Method for treating chemical paper pulp according to claim 1, comprising washing between the step of treating the pulp with ozone and the step of alkaline extraction.

8. Method for treating chemical paper pulp according to claim 7, comprising adding the magnesium ions between washing and the alkaline extraction step.

9. Method for treating chemical paper pulp according to claim 7, wherein said washing comprises washing in water.

10. Method for treating chemical paper pulp according to claim 1, comprising carrying out the alkaline extraction step using a soda solution.

11. Method for treating chemical paper pulp according to claim 1, wherein the chemical pulp is a kraft pulp or sulphite pulp.

12. Method for treating chemical paper pulp according to claim 1, further comprising, upstream of the step of treating the pulp with ozone, or downstream of the step of alkaline extraction, at least one step of pulp processing with hydrogen peroxide.

13. Method for treating chemical paper pulp according to claim 1, wherein the magnesium ions represent between 0.02% and 0.1% by weight of the dry weight of the pulp.

* * * * *